US009717282B1

(12) United States Patent
Hays et al.

(10) Patent No.: US 9,717,282 B1
(45) Date of Patent: Aug. 1, 2017

(54) GARMENTS COMPRISING WIDE, ABDOMINAL-SHAPING WAISTBANDS AND METHODS OF ASSEMBLING THE SAME

(71) Applicant: Spanx, Inc., Atlanta, GA (US)

(72) Inventors: Tosha Hays, Atlanta, GA (US); Julie Lotz, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 339 days.

(21) Appl. No.: 14/534,086

(22) Filed: Nov. 5, 2014

Related U.S. Application Data

(60) Provisional application No. 61/935,114, filed on Feb. 3, 2014.

(51) Int. Cl.

| | |
|---|---|
| ***A41C 1/08*** | (2006.01) |
| ***A41C 5/00*** | (2006.01) |
| ***A41C 1/12*** | (2006.01) |
| ***A41D 1/00*** | (2006.01) |

(52) U.S. Cl.
CPC ..... *A41C 1/08* (2013.01); *A41C 1/12* (2013.01); *A41C 5/00* (2013.01); *A41D 1/00* (2013.01)

(58) Field of Classification Search
CPC ..... A41D 9/00; A41D 13/00; A41D 1/062; A41D 1/20; A41D 1/06
USPC .... 2/227, 228, 236, 237, 220, 221, 211, 212
See application file for complete search history.

(56) References Cited

U.S. PATENT DOCUMENTS

| | | | | |
|---|---|---|---|---|
| 5,946,730 | A * | 9/1999 | Blair | A41D 1/06 2/220 |
| 6,311,333 | B1 * | 11/2001 | Batra | A41D 1/06 2/221 |
| 7,814,575 | B2 * | 10/2010 | Hendrickson | A41D 1/20 2/227 |
| 7,900,276 | B2 * | 3/2011 | Hendrickson | A41D 1/20 2/227 |
| RE43,531 | E * | 7/2012 | Hendrickson | A41C 1/10 2/227 |
| 2004/0210987 | A1 * | 10/2004 | Carney | A41D 1/20 2/236 |
| 2006/0010571 | A1 * | 1/2006 | Oakley | A41D 1/062 2/227 |
| 2013/0095730 | A1 * | 4/2013 | Jensen | A41C 1/003 450/95 |

OTHER PUBLICATIONS

Alexia Fabric Specification 33520, American Cotton Growers (Nov. 20, 2012).
JAG® Jeans Pull-On Pants, available at http://www.zappos.com/jag-jeans-paley-pull-on-boot-in-blue-shadow-blue-shadow?ef_id=UVpCTAAABGp8OytS:20131118192619:s (accessed Nov. 18, 2013).
Solace Fabric Specification 33812, American Cotton Growers (Nov. 20, 2012).

* cited by examiner

*Primary Examiner* — Gloria Hale
(74) *Attorney, Agent, or Firm* — Meunier Carlin & Curfman LLC

(57) ABSTRACT

Disclosed herein are lower-body garments having wide, abdominal-shaping waistbands, and methods of making the same. The garments disclosed herein have wide, abdominal-shaping waistbands with features tailored to smooth and restrain the garment-wearer's abdominal area and/or reduce the undesirable "muffin top" effect that can occur when garments cinch at the waist.

20 Claims, 13 Drawing Sheets

GARMENTS COMPRISING WIDE, ABDOMINAL-SHAPING WAISTBANDS AND METHODS OF ASSEMBLING THE SAME

CROSS-REFERENCE TO RELATED APPLICATIONS

This application claims the benefit of priority to U.S. Provisional Patent Application No. 61/935,114, filed Feb. 3, 2014, which is incorporated herein by reference in its entirety.

TECHNICAL FIELD

This disclosure relates to clothing and, in particular, to shaping garments. This disclosure also relates to methods of assembling the garments disclosed herein.

BACKGROUND

Garments are designed to cover exposed skin of a wearer. Designers want garments, including lower body garments, to stay in place when worn. Designers provide various ways of holding a lower body garment in place around the waist, such as elastomeric waistbands or belts. These solutions tend, however, to cinch at the waist and cause an undesirable "muffin top" effect that is bulging of abdominal fat over the waistband, belt, or other cinching mechanism. It would be desirable to eliminate the muffin top effect.

SUMMARY

Disclosed herein are garments for shaping abdominals of a wearer, the garments comprising a lower-body portion configured to extend inferiorly along at least a portion of the legs of the wearer, and a wide, abdominal-shaping waistband having a stiffness ranging from 0 pounds to 6 pounds, wherein the waistband has a height relative to a front crotch seam of the garment of 40% to 200%. In some examples, the wide, abdominal-shaping waistband has a superior edge laterally narrower than an inferior edge of the abdominal-shaping waistband. In some aspects, the superior edge has a width of 85% to 92% of a width of the inferior edge of the waistband. In some aspects, the wide, abdominal-shaping waistband has a central section configured to apply greater pressure on the wearer than the superior edge of the wide, abdominal-shaping waistband. In some examples, the wide, abdominal-shaping waistband comprises a woven fabric. The wide, abdominal-shaping waistband can comprise an elastomer-containing fabric comprising 1% to 3% of an elastomer. The wide, abdominal-shaping waistband can have a height of 3 inches to 12 inches, and/or a height relative to a front crotch seam of the garment of 40% to 70%.

The wide, abdominal-shaping waistband can have a central section that is laterally narrower than the inferior edge of the wide, abdominal-shaping waistband, and the central section of the wide, abdominal-shaping waistband can be wider than the superior edge of the wide, abdominal-shaping waistband. In some examples, the wide, abdominal-shaping waistband has a filling stretch of 31% to 40%. In some examples, the wide, abdominal-shaping waistband comprises a fabric having a weight of 7 oz/yd$^2$ to 14 oz/yd$^2$.

Also disclosed herein are methods of assembling garments, comprising cutting two front waistband panels of a height of 3 inches to 12 inches such that they have superior edges laterally narrower than inferior edges, cutting two rear waistband panels of a height of 3 inches to 12 inches such that they have superior edges laterally narrower than inferior edges, sewing the two front waistband panels together at the superior edges, sewing the two rear waistband panels together at the superior edges, sewing lateral edges of the front waistband panels to lateral edges of the rear waistband panels, and sewing the inferior edges of the front waistband panels and the inferior edges of the rear waistband panels to a top edge of a lower-body portion.

The details of one or more aspects of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Figure 1:
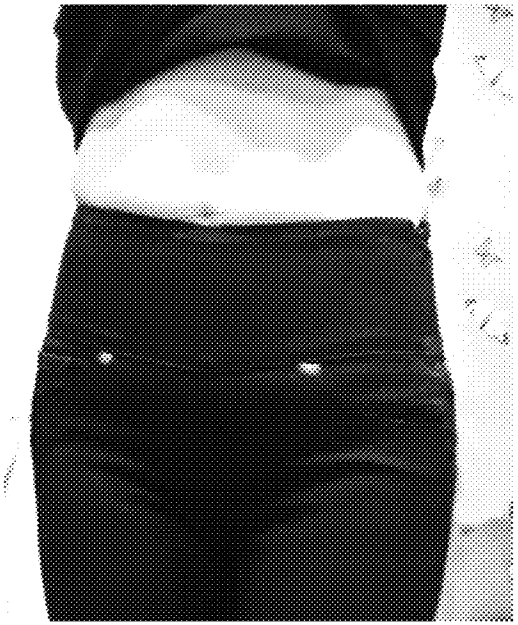
PRIOR ART FIG. 1
FIG. 1 is a partial front view photograph of someone wearing a garment with a conventional waistband (left-side) compared with a partial front view picture of the same person wearing a garment having a wide, abdominal-shaping waistband (right-side).
Figure 1:
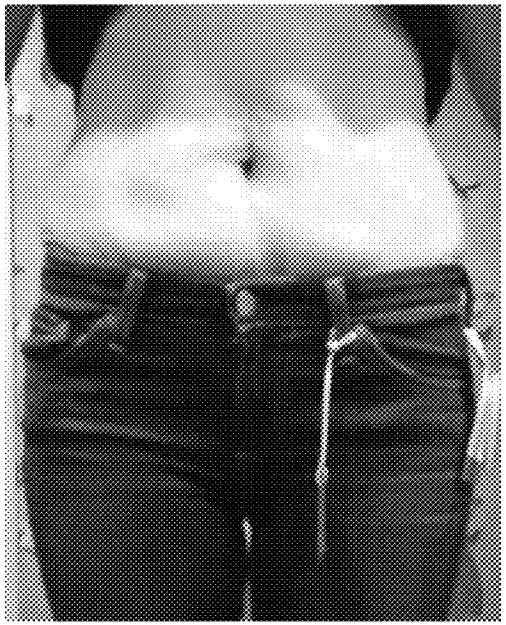
PRIOR ART FIG. 1
Figure 2:
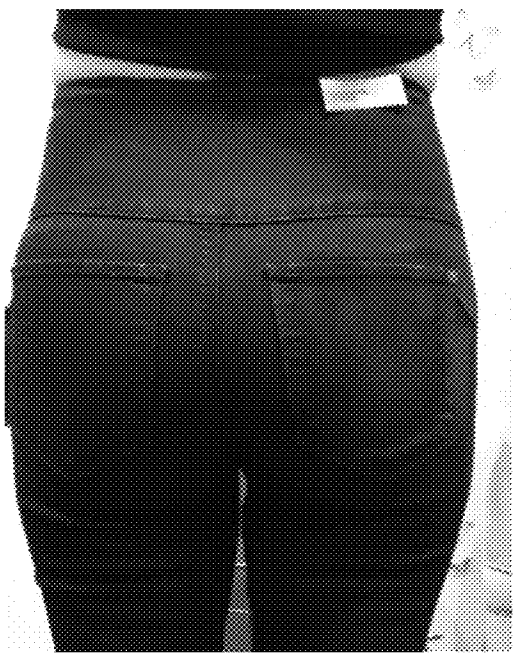
PRIOR ART FIG. 2
FIG. 2 is a partial rear view photograph of someone wearing a garment with a conventional waistband (left-side) compared with a partial rear view picture of the same person wearing a garment having a wide, abdominal-shaping waistband (right-side).
Figure 2:
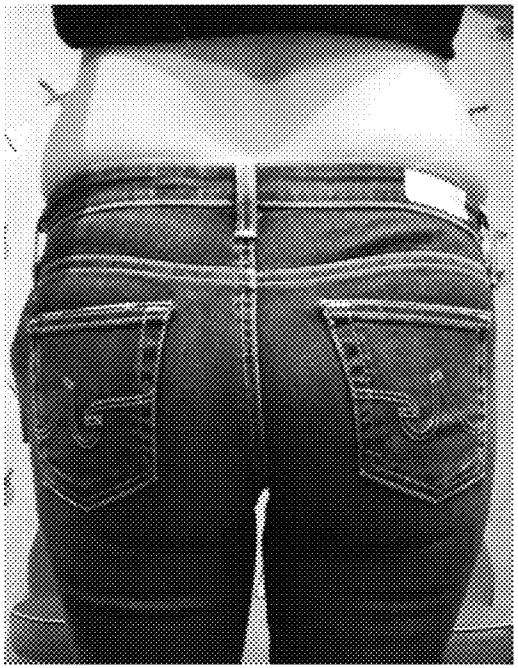
PRIOR ART FIG. 2
Figure 3:
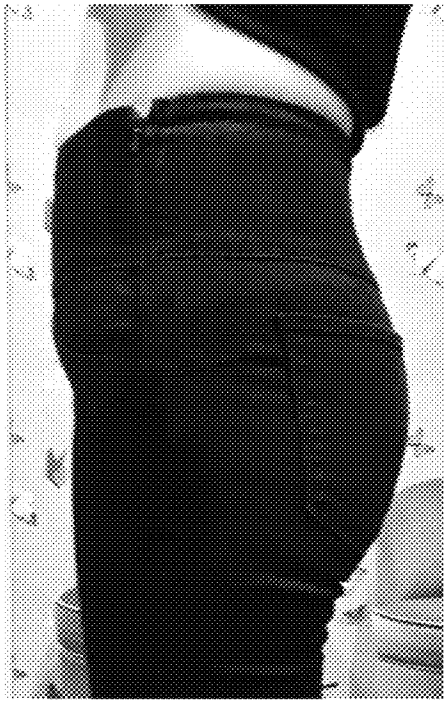
PRIOR ART FIG. 3
FIG. 3 is a partial front view photograph of someone wearing a garment with a conventional waistband (left-side) compared with a partial front view picture of the same person wearing a garment having a wide, abdominal-shaping waistband (right-side).
Figure 3:
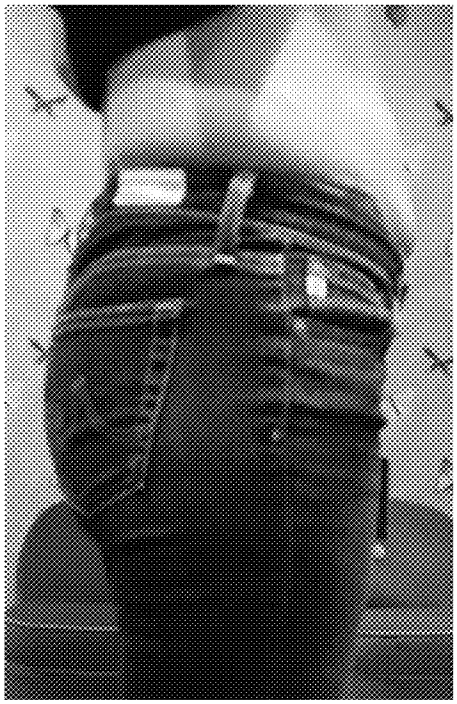
PRIOR ART FIG. 3

Disclosed herein are lower-body garments having wide, abdominal-shaping waistbands, and methods of making the same. The garments disclosed herein have wide waistbands with features tailored to smooth and restrain the garment-wearer's abdominal area and/or reduce the undesirable "muffin top" effect that can occur when garments cinch at the waist. FIGS. 1-3 are comparative, "before-and-after" photos showing a garment wearer's abdominal area when wearing a garment with a conventional waistband (on the left) versus a garment with a wide, abdominal-shaping waistband as disclosed herein (on the right). The smoothing and restraining of the abdominal area and reduction to the undesirable "muffin top" effect can be seen in FIGS. 1-3.

The waistbands disclosed herein are designed to achieve a quantity and pattern of distribution of pressure to smooth and restrain a garment wearer's abdominal areas without the compressed waistband causing undesirable cinching and muffin top effect. This distribution of pressure can be accomplished by balancing the properties of the fabric in the waistband (e.g., stiffness, elasticity) with its cut and positioning on the garment. For instance, the waistband can be cut to distribute a higher amount of pressure at the center, such that a center portion of the waistband exerts more pressure on the wearer than a superior portion and/or an inferior portion of the waistband. The distribution of pressure caused by the cut of the waistband is an example of a design feature that can help achieve a desired quantity and pattern of distribution of pressure across a garment wearer's abdominal area.

Various features of the waistband can be tailored to smooth and restrain the garment-wearer's abdominal area and/or reduce muffin top, as discussed herein. Those various features can include, for instance, the surface area covered by the waistband, the cut of the waistband, the composition of the fabric in the waistband, the position of the waistband, the properties of the waistband fabric (e.g., stiffness), and the number of layers of fabric in the waistband.

It is not simply that the waistband is "wide" that causes the desirable abdominal-shaping. For instance, many conventional maternity garments feature wide waistbands that extend from the top of a lower-body garment, such as a pair of pants, across the pregnant belly of the garment wearer. Those wide waistbands are typically a single layer of stretchy material intended to allow the pregnant belly to grow and expand, and are not constructed to restrain or shape the abdominal area or reduce muffin top.

Other wide-waistband garments feature a wide waistband merely to improve the aesthetics of the garment, and are not intended to behave in a different manner than a typical waistband. For instance, those wide waistbands are typically not made of a compressive fabric, nor are they cut or constructed to restrain or compress the garment-wearer's abdominal area.

Other wide-waistband garments, such as the JAG® Jeans Pull-On Pants, are advertised as having a "[w]ide waistband [that] keeps you snug and flat without compromising on comfort or fit." The Pull-On Pants are touted as having "[n]o zippers, no buttons—no fuss!" and promise "[n]o dreaded muffin top in these jeans!" The Pull-On Pants are cut and constructed to allow the garment-wearer to slide the garment over the hips and wear the garment without the need for a zipper or other closure.

Figure 13:
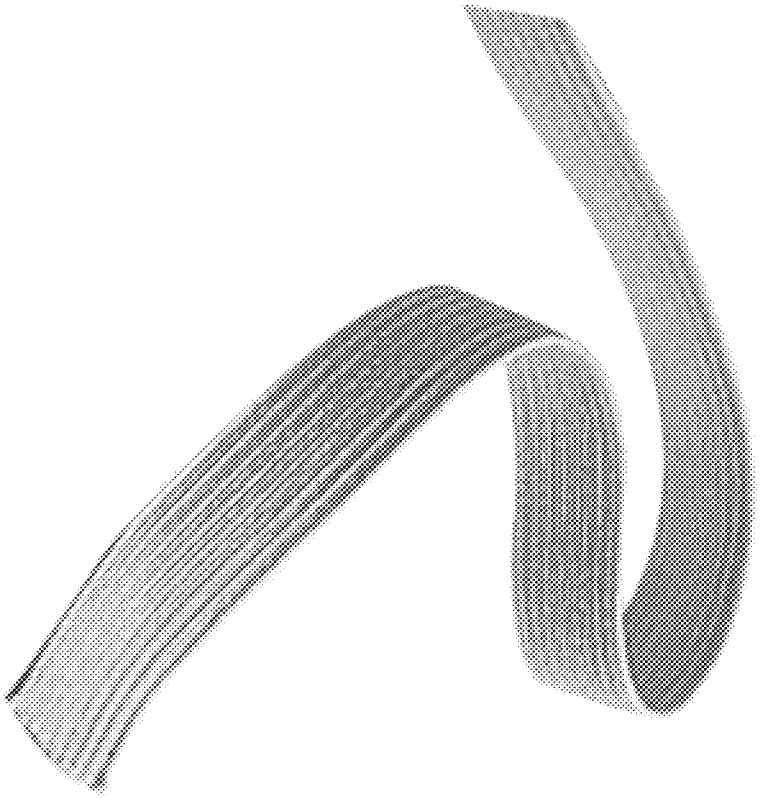
FIG. 13 PRIOR ART
FIG. 13 is an image of a narrow elastic.

Those wide waistbands, however, are typically not cut or constructed in a manner to achieve the quality and pattern of distribution of pressure to smooth and restrain a garment wearer's abdominal area while reducing muffin top. For instance, those wide waistbands are constructed to cover a smaller surface area of the garment wearer's abdominal area, compared to the abdominal-shaping waistbands disclosed herein. Additionally, those wide waistbands are shorter, and the Pull-On Pants may rest in a lower location on the wearer than the garments described herein. Because the Pull-On Pants may rest in a lower location, they may be prone to rolling down in use. Pants that roll down on the wearer in use are often uncomfortable and can be unsightly. Accordingly, the Pull-On Pants feature an elastic band (known as a "narrow elastic," an example of which is shown in FIG. 13) sewn into the waistband, which may help prevent roll down. The narrow elastic in the Pull-On Pants also provides stability for its construction and fabrication. The garments and waistbands disclosed herein are constructed to, for instance, reduce muffin top and prevent roll down without the need for a narrow elastic in the waistband.

FIGS. 4-7 depict a garment 10 comprising a lower-body portion 12 sewn to a wide, abdominal-shaping waistband 14. Lower-body portion 12 is depicted as a pair of pants in FIGS. 4-7. The lower body portion 12, for example, may be a pair of pants with pant legs 16. The wide waistband 14 is advantageously constructed to have a geometry and elasticity that balances support with compression without an objectionably harsh transition that causes the muffin top effect.

As shown in FIGS. 4-7, the garment 10 comprises lower-body portion 12, which can include pant legs 16, a lower abdominal portion 18, a buttocks-covering portion 20, and a crotch portion 22. The lower-body portion 12 can be formed by sewing two front panels 24 and two rear panels 26 together to form crotch seams 28, side seams 30, and inseams 32. In particular, a superior portion of the medial edges of the two front panels 24 can be sewn together to form a front crotch seam 28. The superior portion of the sewn-together front panels 24 forms the lower abdominal portion 18. A superior portion of the medial edges of two rear panels 26 can be sewn together to form a rear crotch seam 28. The superior portion of the sewn-together rear panels 26 forms the buttocks-covering portion 20. The lateral edges of the two front panels 24 can be sewn to the lateral edges of the two rear panels 26 to form side seams 30. An inferior portion of the medial edges of the front panels 24 can be sewn to an inferior portion of the medial edges of the rear panels 26 to form inseams 32 of the lower-body portion 12. When sewn together, the crotch seams 28 and inseams 32 meet at intersection 34. The inferior portions of the sewn-together panels form the elongate shapes of the pant legs 16 with a foot opening at the distal end of each. The superior portions of the sewn-together panels (in particular the lower abdominal portion 18 and the buttocks-covering portion 20) form a core-encircling portion 36 to encircle and compress the abdominal area of the wearer.

The core-encircling portion 36 is configured to extend snugly around a lower portion of the wearer's abdominal area, sides, and back, as shown in FIGS. 1-7. Generally, as shown in the pictures on the left in FIGS. 1-3, this snugness would conventionally result in a muffin top, if the core-encircling portion 36 was designed for and used with a conventional waistband. However, as described above, the core-encircling portion 36 can be sewn to wide waistband 14, which can be cut and constructed of materials selected to provide support without forming the undesirable muffin top in the conventional garments of FIGS. 1-3 (left side).

The core-encircling portion 36 has a top edge 38 that connects (e.g., via sewing) to the wide waistband 14. The top edge 38 can be the same height (equal to the length of front crotch seam 28) as a conventional-waistband garment. The top edge 38 may sit lower on the hips of the wearer, and have a shorter height, compared to a conventional-waistband garment. For instance, the top edge 38 may have a height that is 1 inch to 5 inches shorter than a conventional-waistband garment. For instance, the top edge 38 may have a height that is 5% to 50% (e.g., 10% to 35%) shorter than a conventional-waistband garment. For instance, in one example, a conventional garment may have a top edge height (equal to the length of the front crotch seam) of 10 inches, while the top edge of the wide-waistband garment described herein may have a top edge height (equal to the length of the front crotch seam) of 7.5 inches. In that example, the wide-waistband garment has a top edge height (equal to the length of the front crotch seam) that is 2.5 inches shorter, and 25% shorter, than the conventional waistband garment.

Pants, such as jeans, are particularly well-suited for use with the wide, abdominal-shaping waistbands described herein. Jeans are often styled to have a tighter fit, and often comprise a relatively stiff fabric. Tight-fitting jeans, for instance, tend to cause more muffin top and therefore benefit from the wide, abdominal-shaping waistband. Pants are also anchored in place more than, for instance, a skirt. Pants and jeans also extend over the large surface area of the legs, and therefore tends to slide down at the back when squatting, which at the same time emphasizes the muffin top due to tightness and inelasticity. Thus, tight-fitting jeans can be more prone to causing muffin top than other lower-body garments.

The wide waistband can be used with just about any lower body garment that has an upper edge extending around the core of the wearer (e.g., pants, a skirt, leggings, shorts, tights, hosiery, and activewear). However, as described above, pants and more tailored fits tend to benefit from the wide waistband due to their tendency to cause or exacerbate the muffin-top effect.

The lower body garments can comprise a range of fabrics (e.g., cotton, polyester, twill, chino, corduroy, leather, wool, blends of fabrics, etc.). When the lower-body garments comprise fabrics that provide compression and/or tailored stiff fabrics, such as the fabrics used for tight-fitting jeans, they can be more prone to muffin top and then may especially benefit from the wide waistband.

Figure 4:
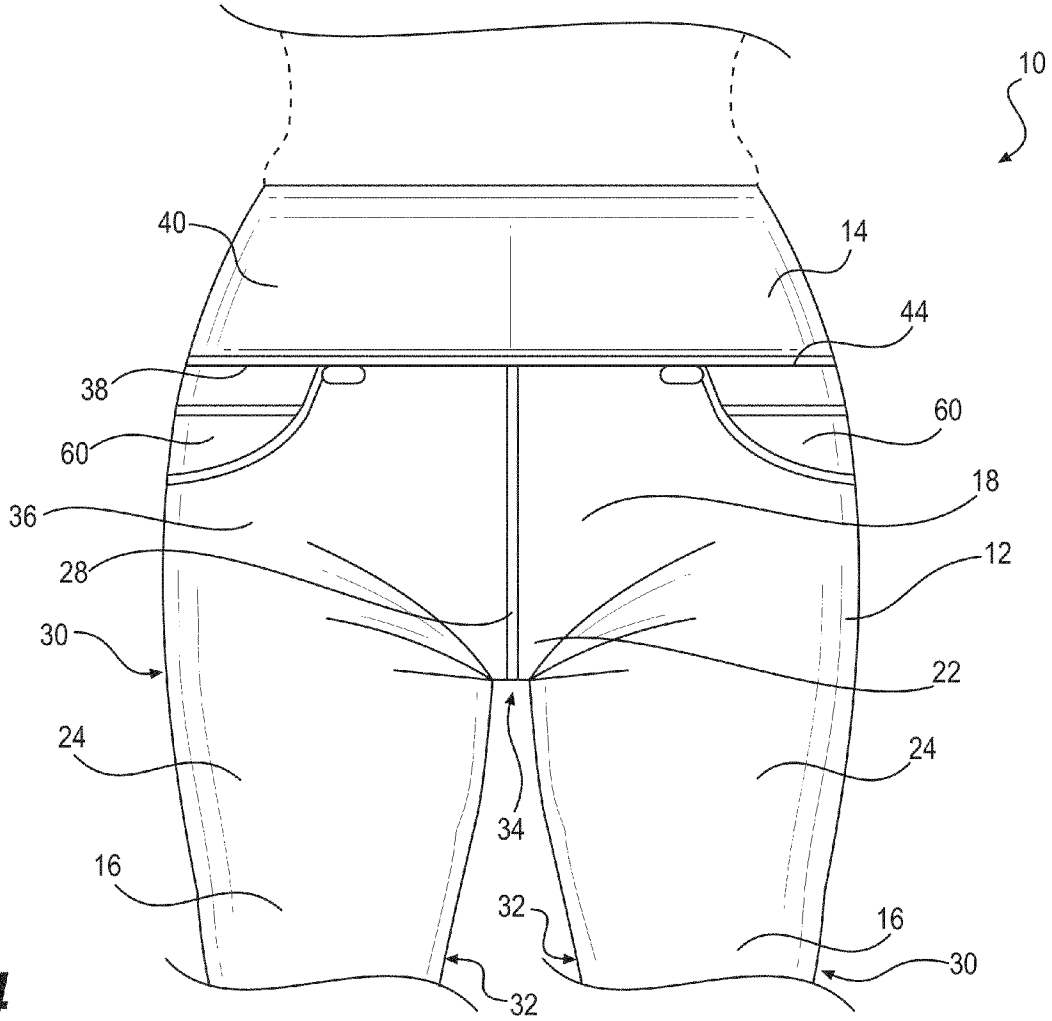
FIG. 4 is a partial front elevation view depicting the front of a garment having a wide, abdominal-shaping waistband.

FIG. 4 shows a front view of garment 10, comprising lower-body portion 12 with a wide, abdominal-shaping waistband 14. The wide waistband 14 of garment 10 has a front panel 40. Front panel 40 of wide waistband 14 has a superior edge 42, an inferior edge 44, a first lateral edge 46, and a second lateral edge 48. The inferior edge 44 of front panel 40 is sewn to the top edge 38 of the core-encircling portion 36, above lower abdominal portion 18.

Figure 5:
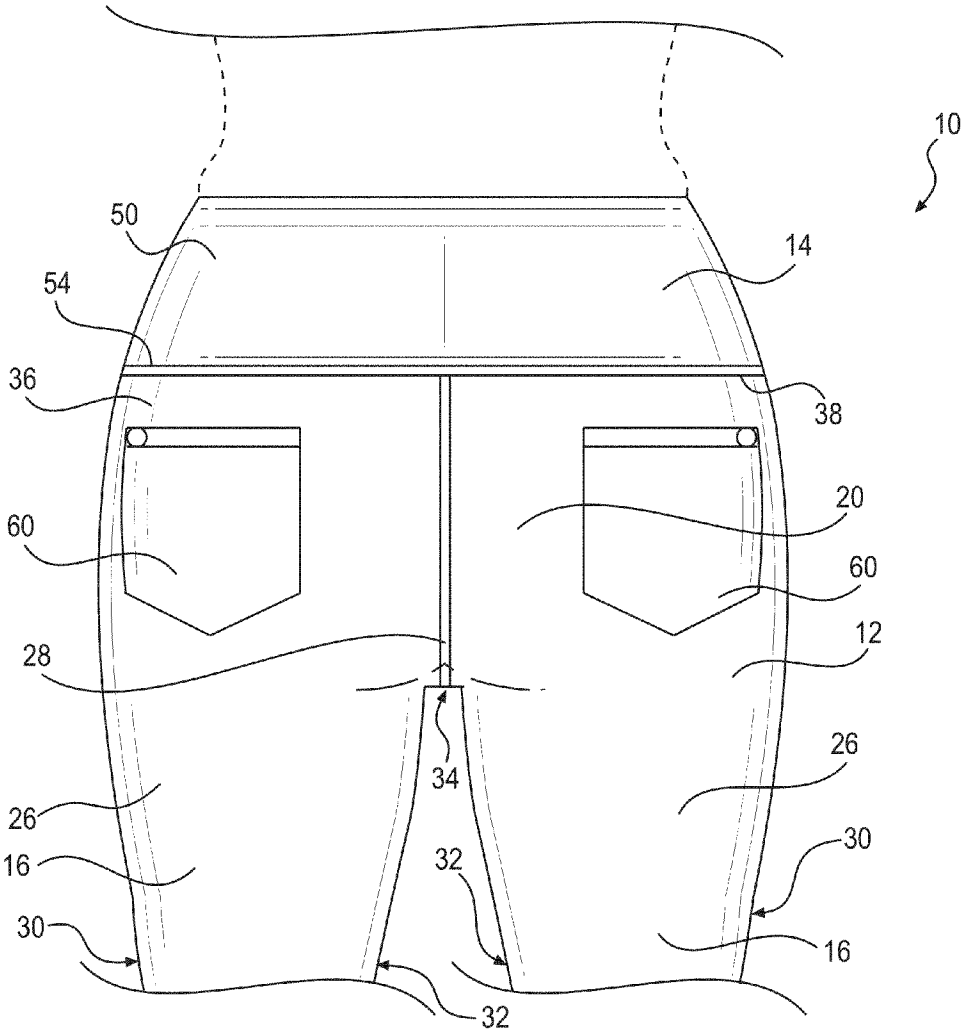
FIG. 5 is a partial rear elevation view depicting the garment of FIG. 4.

FIG. 5 shows a back view of the garment 10, comprising lower-body portion 12 with a wide, abdominal-shaping waistband 14. The wide waistband 14 of garment 10 has a rear panel 50. Rear panel 50 of wide waistband 14 has a superior edge 52, an inferior edge 54, a first lateral edge 56, and a second lateral edge 58. The inferior edge 54 of rear panel 50 is sewn to the top edge 38 of the core-encircling portion 36, above buttocks-covering portion 20. Garment 10 may optionally include real or faux pockets 60 on the lower-body portion 12.

Figure 6:
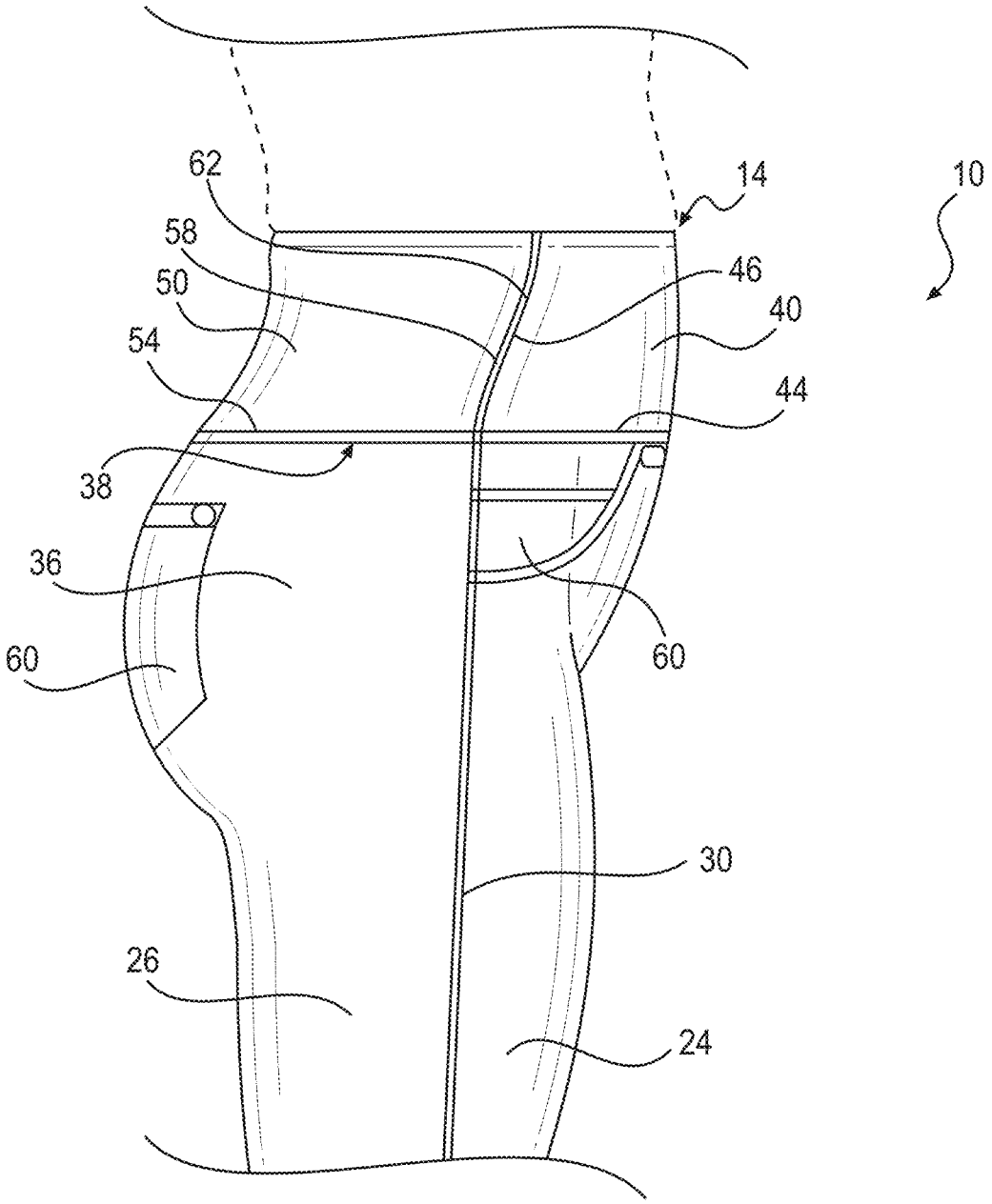
FIG. 6 is a partial left-side elevation view depicting the garment of FIG. 4.

FIG. 6 shows a right-side view of the garment 10, comprising lower-body portion 12 with wide waistband 14. First lateral edge 46 of front panel 40 of wide waistband 14 is sewn to second lateral edge 58 of rear panel 50 of wide waistband 14 to form waistband seam 62.

Figure 7:
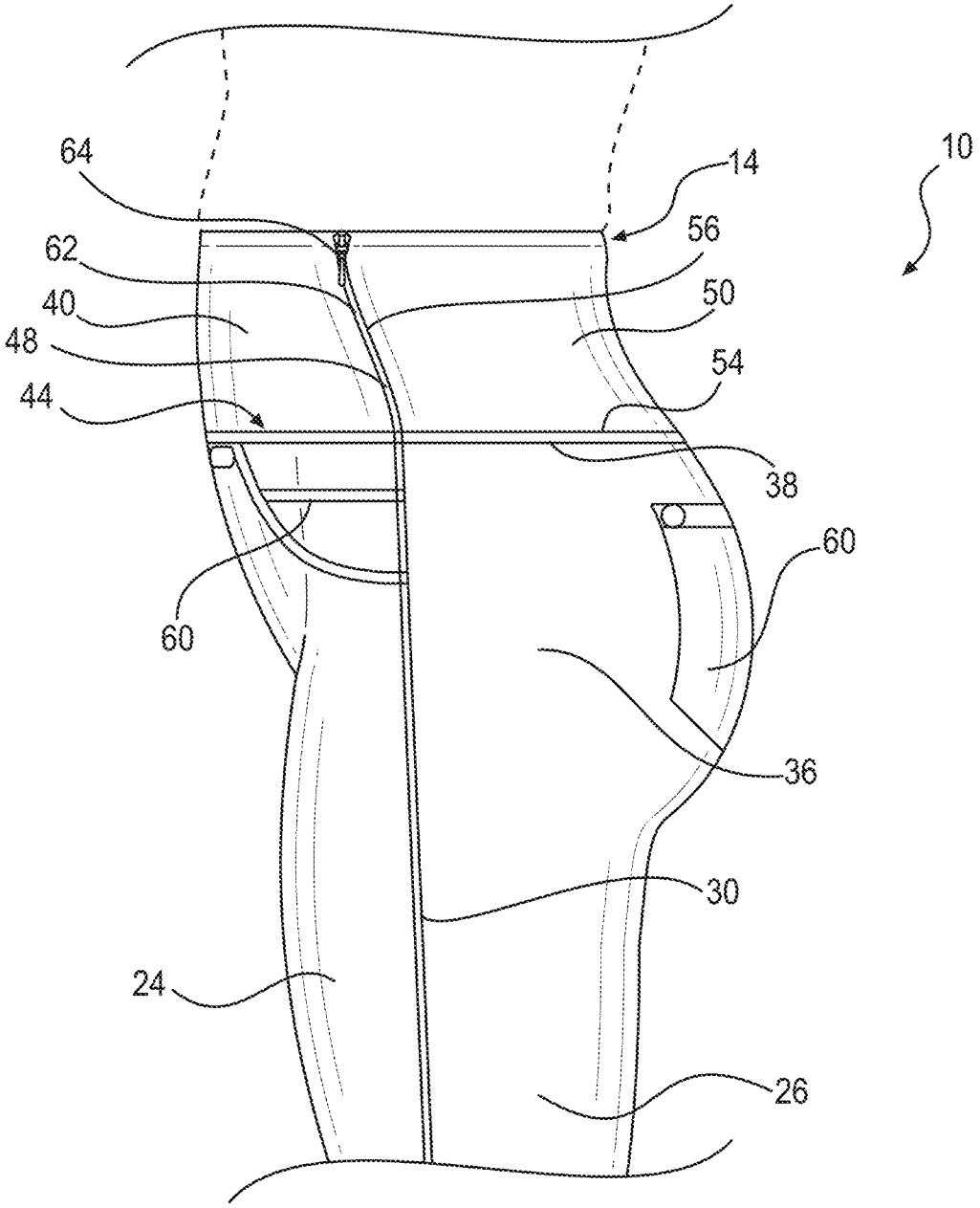
FIG. 7 is a partial right-side elevation view depicting the garment of FIG. 4.
Figure 12:
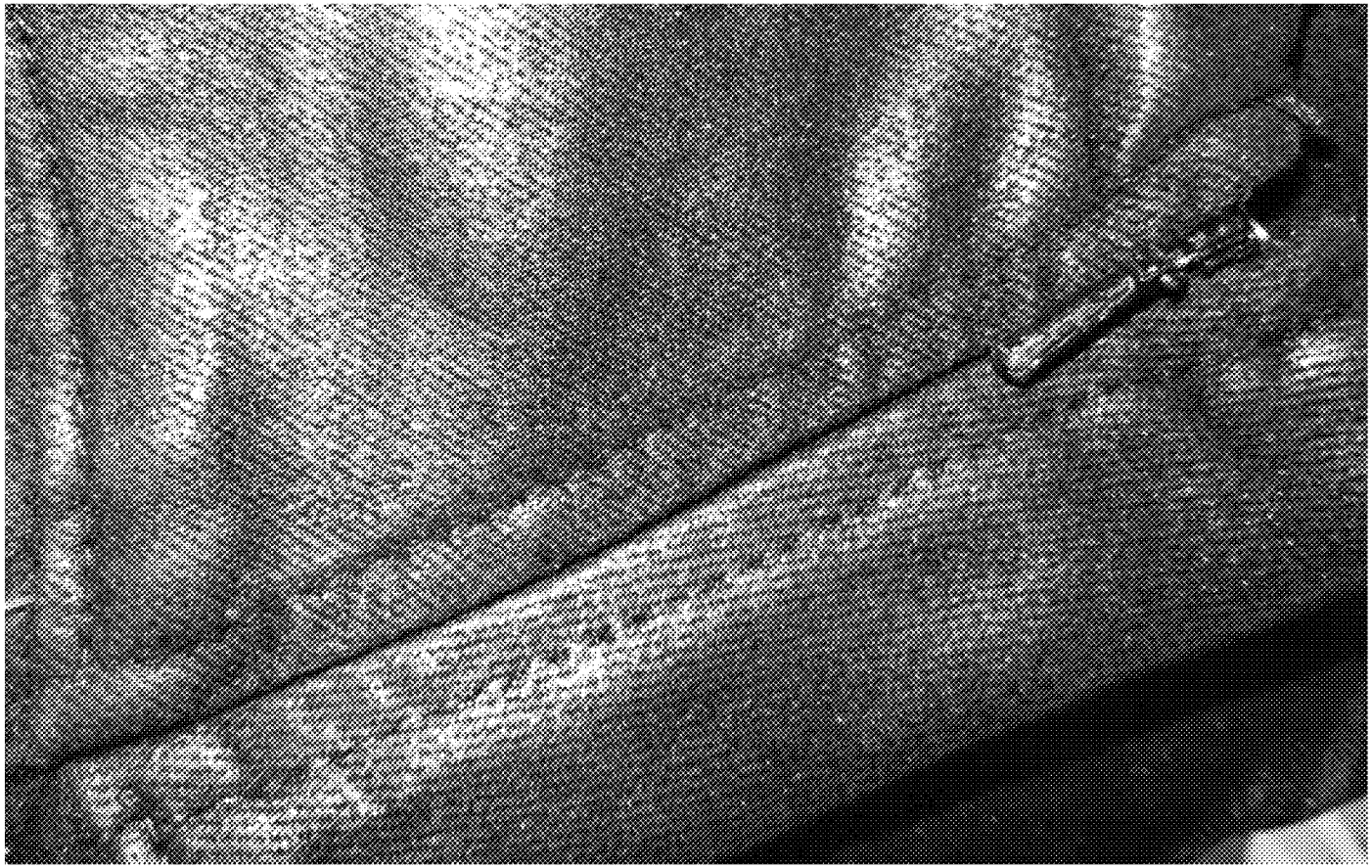
FIG. 12 is a close-up image of the zipper used in the garment of FIG. 4.

FIG. 7 shows a left-side view of garment 10, comprising lower-body portion 12 with wide waistband 14. The second lateral edge 48 of front panel 40 of waistband 14 and the first lateral edge 56 of rear panel 50 of waistband 14 are attached (e.g., by sewing, heat fusing, or a mixture thereof) to closure seam 64. The closure seam 64 depicted in FIG. 7 comprises a zipper 66. Zipper 66 can be an "invisible zipper" wherein the coil teeth are hidden on the reverse side of the zipper tape, such that the coil teeth cannot be seen from the front when it is closed. FIG. 12 shows a close-up view of an exemplary invisible zipper.

The closure seam 64 comprising zipper 66 is depicted as located on the left side of waistband 14 in FIG. 7. The existence, number, and placement of the closure seams can be varied depending upon factors such as aesthetics. In some examples, the waistband does not feature a closure seam. In some examples, the closure seam is on the right side of the garment. In some examples, the closure seam is on the front of the garment. In other examples, the closure seam features is closable by mechanisms other than a zipper (such as by buttons, hook-and-eye closures, or snaps). In some aspects, the garment 10 features a closure seam 64 comprising a zipper and a hook-and-eye closure.

In examples featuring a closure seam, the closing mechanism (e.g., zipper, buttons, etc.) must be strong enough to withstand the tension forces exerted by the elasticity and amount of stretch of the wide waistband 14. In some examples, zipper 66 is a heavy duty zipper, as defined by JIS 53015 (2007). In some examples, zipper 66 is an ultra heavy duty zipper, as defined by JIS 53015 (2007). Exemplary commercially available zippers include, but are not limited to, YKK USA #3 CONCEAL® Heavy Duty Zipper, Model No. 0030959 (shown in FIG. 12), and YKK #4.5 Zipper with Exposed Teeth. The zipper, when used, can have a length from 4 inches to 8 inches (e.g., 6.5 inches).

Zipper strength can be determined based on JIS 53015 (2007). JIS 53015 (2007) provides, in addition to test methods, standards of strengths by zipper type (e.g., heavy duty, ultra heavy duty). The strength parameters of various zipper types, as defined by JIS 53015 (2007), is shown below in Table 1.

Table 1: JIS 53015 (2007) Standards of Strength by Zipper Type

| Strength parameters | Chain Crosswise Strength (per 2.5 cm) | | | | | Top stop holding strength | | Bottom stop holding strength | | | |
|---|---|---|---|---|---|---|---|---|---|---|---|
| | Individual element | | | Continuous elements | | | | Metal Slider | | Plastic Slider | |
| Kinds of Zippers | Reinforced Tape | Tapes other than cotton/knit tape | Aluminum element cotton/knit tape | Tapes other than cotton/knit tape | Cotton/knit tape | Metal Slider | Plastic Slider | Individual element (Aluminum/cotton/knit tape) | Continous elements | Individual element | Continous elements |
| UL | 300 | 150 | 100 | 200 | 150 | 40 | 30 | 15 | 30 | 15 | 20 |
| L | 400 | 230 | 150 | 250 | 200 | 50 | 40 | 250 | 200 | 30 | 30 |

-continued

| | | | | | | | | | | | |
|---|---|---|---|---|---|---|---|---|---|---|---|
| M | 500 | 300 | 200 | 450 | 200 | 70 | 60 | 40(30) | 50 | 40 | 60 |
| MH | 600 | 390 | 250 | 540 | 300 | 100 | 80 | 50 | 70 | 60 | 90 |
| H | 700 | 490 | 300 | 590 | 350 | 120 | 100 | 80 | 120 | 100 | 120 |
| UH | 800 | 690 | — | — | — | 200 | 170 | 150 | — | 150 | — |

| Strength para-meters | Separating unit crosswise strength | | Retainer | Slider lock strength Metal Slider | | Slider lock strength Plastic Slider | | Slider tab pull off strength (90°) | | Slider pull-tab twist strength | |
|---|---|---|---|---|---|---|---|---|---|---|---|
| Kinds of Zippers | Individual element | Continous elements | pull off strength | Individual element | Continous elements | Individual element | Continous elements | Metal Slider | Plastic Slider | Metal Slider | Plastic Slider |
| UL | 50 | — | 40 | 15 | 10 | 10 | 10 | 60 | 40 | 15 | 10 |
| L | 70 | 50 | 50 | 25 | 10 | 20 | 10 | 80 | 50 | 15 | 10 |
| M | 80 | 80 | 60 | 40 | 35 | 25 | 35 | 150 | 100 | 45 | 35 |
| MH | 120 | 120 | 80 | 50 | 50 | 35 | 35 | 170 | 100 | 70 | 45 |
| H | 150 | 150 | 120 | 60 | 60 | 50 | 50 | 200 | 150 | 70 | 60 |
| UH | 300 | — | 200 | — | — | — | — | 300 | 300 | — | — |

In Table 1, strength is measured in lbs/force, and

UL=ultra lightweight zipper;

L=lightweight zipper;

M=medium weight zipper;

MH=medium-heavy weight zipper;

H=heavy weight zipper; and

UH=ultra heavy weight zipper.

Further, though the example depicted in the FIGURES show the wide, abdominal-shaping waistband 14 as comprising two panels—a front panel 40 and a rear panel 50—other aspects fall within the scope of the disclosure. For instance, the wide, abdominal-shaping waistband can be made of one continuous waistband that wraps entirely around the garment-wearer's abdominal area. The waistband may not include a closure seam. Or, the waistband can be made of three panels. For instance, the three panels could comprise a back panel and two front panels. The two front panels would be connected to the back panel at the side-seams on the side of the garment wearer. The two front panels could connect to each other via a closure seam at the front of the garment.

Figure 8:
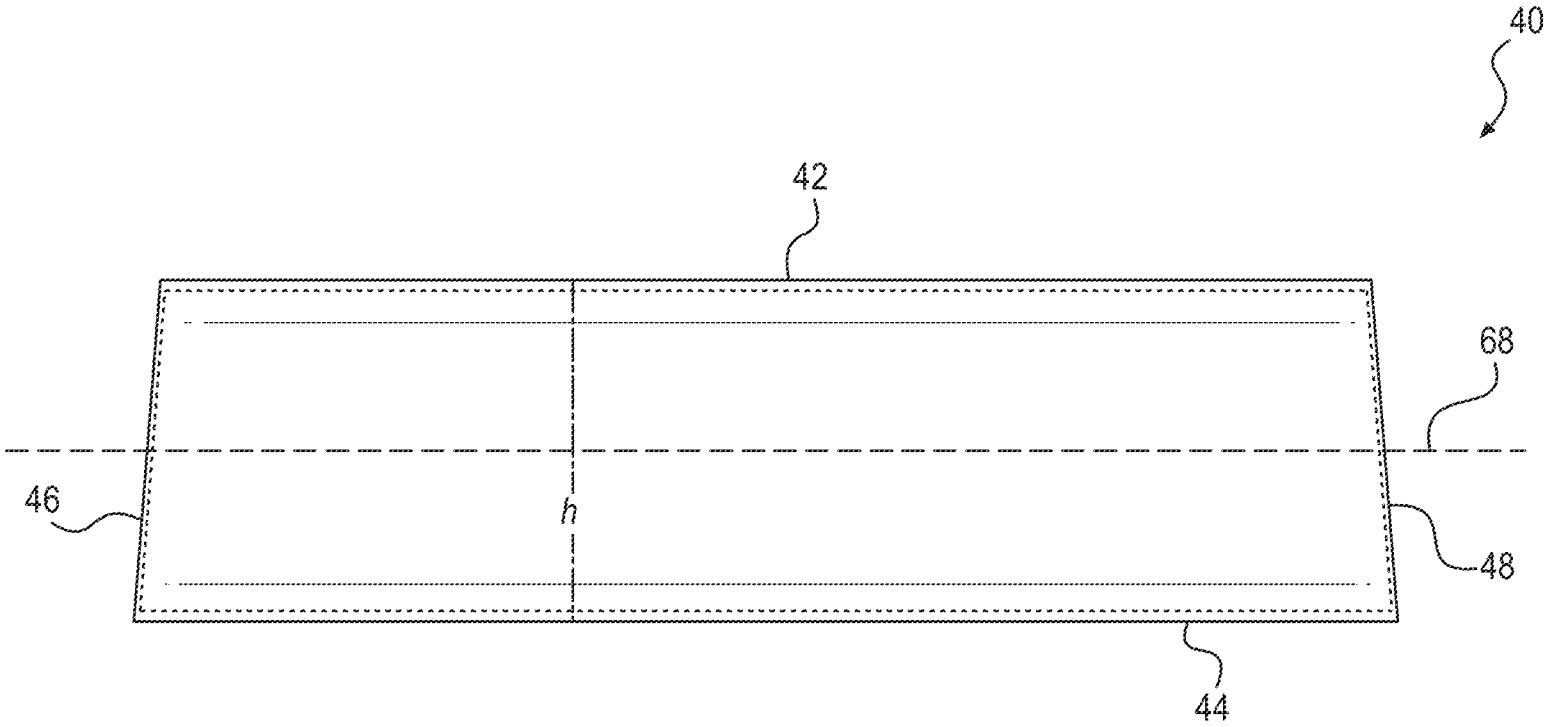
FIG. 8 shows a plan view of a front portion of a wide, abdominal-shaping waistband.

FIG. 8 shows a deconstructed front panel 40, having a superior edge 42, an inferior edge 44, a first lateral edge 46, and a second lateral edge 48. The midline 68 is also depicted.

Figure 9:
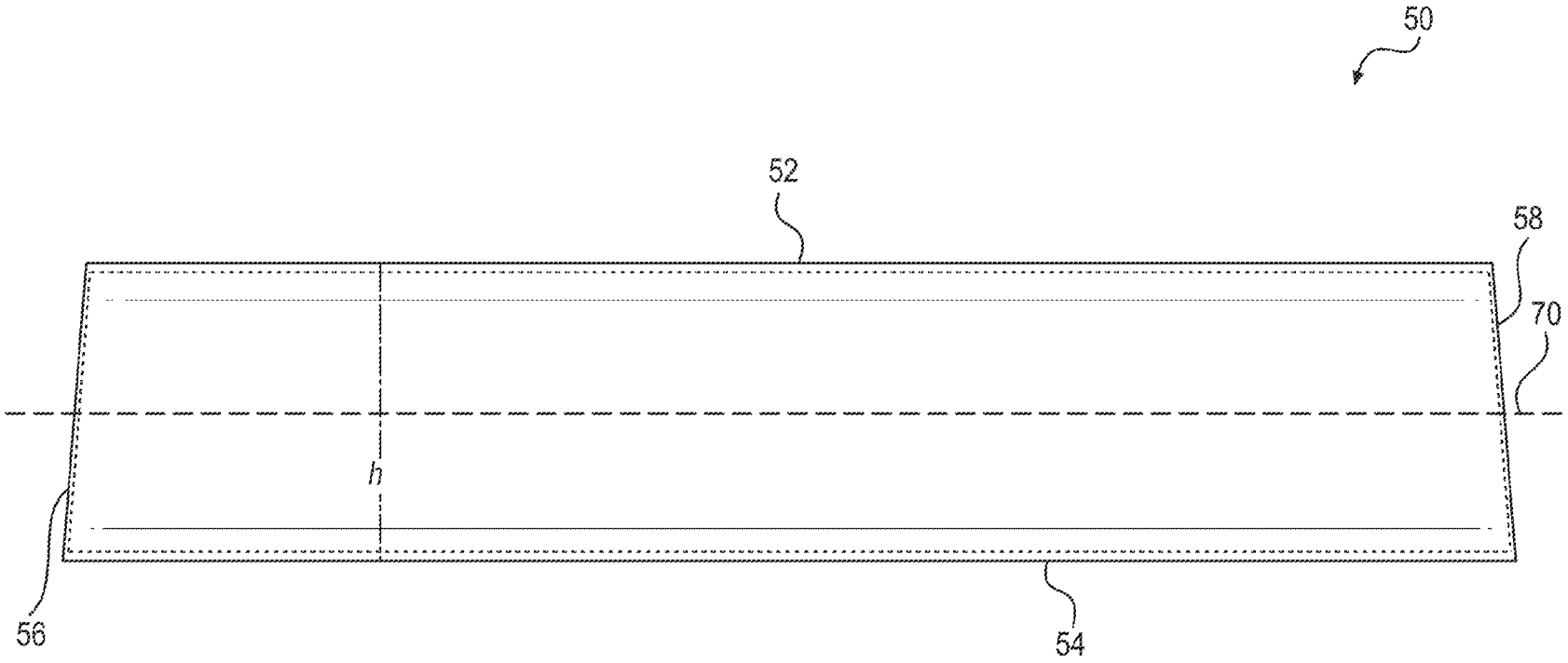
FIG. 9 shows a plan view of a rear portion of a wide, abdominal-shaping waistband.

FIG. 9 shows a deconstructed rear panel 50, having a superior edge 52, an inferior edge 54, a first lateral edge 56, and a second lateral edge 48. The midline 70 is also depicted.

As shown in FIGS. 8 and 9, the lengths of superior edges 42 and 52 are shorter than the lengths of inferior edges 44 and 54. The lateral edges 46, 48, 56, and 58 taper from the shorter superior edges 42 and 52 to the longer inferior edges 44 and 54. This is not simply to accommodate the gradual increase in circumference from the waist to the hips of an average garment wearer. Indeed, the shape and severity of this taper—which can be created by the particular cut of the waistband panels 40 and 50—can help achieve a quantity and pattern of distribution of pressure to smooth and restrain a garment wearer's abdominal areas without the compressed waistband causing undesirable cinching and muffin top effect. In some aspects described herein, the shape of the waistband and/or panels thereof can provide more targeted compression in certain regions to help give the garment wearer a specific effect (e.g., to accentuate the hour-glass figure, or add additional compression at the waist, or to have less compression near the superior edge of the waistband to reduce the "muffin-top" effect).

The gradual increase in circumference from the waist to hips of an individual garment wearer varies widely, depending upon age, size, gender, height, weight, and shape (for instance). Nonetheless, the clothing industry has various "sizes" intended to accommodate individual garment wearers, with their varied shapes, in to a set number of garment sizes. Accordingly, the garments herein are designed, in some aspects, such that the garment 10 increases in circumference from the waist to hips of the garment (e.g., from the inferior edge to the superior edge of the panel) at a different rate than the corresponding increase in circumference of the standard garment wearer's dimensions that correspond to the "size" of the garment.

For instance, FIGS. 8 and 9 depict a gradual slope from inferior edges to superior edges. This creates a garment with a circumference that increases at a smaller rate than the garment wearer. Accordingly, the pressure exerted when the garment is worn with the depicted shape for panels 40 and 50 may have a particular distribution; less pressure is applied at the top of the waistband (along the inferior edges), increased pressure is applied along midlines 68 and 70, and an intermediate pressure applied at the bottom of the waistband (along the inferior edges). To accentuate the increased pressure along midlines 68 and 70, the panels 40 and 50 can also be cut such that the lateral edges 46, 56, 48, and 58 taper inward. In that example, the midlines 68 and 70 can be shorter than superior edges 42 and 52. In another aspect, the midlines 68 and 70 are the same length as superior edges 42 and 52. The pattern and distribution of pressure applied by the waistband on the garment wearer's abdominal region causes increased compression to smooth and restrain the abdominals, while allowing a gradual transition to less pressure toward the top of the waistband. This gradual transition can help prevent muffin top.

The particular sizes and dimensions of the waistband portions 40 and 50 can vary greatly, depending on the intended garment wearer, as mentioned above. For instance, front panel 40 for an exemplary garment for an adult woman (size small), as depicted in FIG. 8, may have the following dimensions: inferior edge 44 is 14⅝ inches in length, superior edge 42 is 16⅝ inches in length, midline 68 is 15 inches, and the vertical height from inferior edge to superior edge is 4 inches. In another aspect, the front panel 40 for an exemplary garment for an adult woman (size extra large) may have the following dimensions: inferior edge is 17 inches in length, superior edge is 19 inches in length, midline is 18 inches in length, and the vertical height from inferior edge to superior edge is 4 inches. Accordingly, for a standard sized (S to XL) adult woman as described herein, the superior edges can be from 85% to 92% of the length of the inferior edges. For a standard sized (S to XL) adult woman as described herein, the superior edges can be from 94% to 106% of the length of the midline. For a standard sized (S to XL) adult woman as described herein, the midline can be from 80% to 97% of the length of the inferior edges. These particular dimensions can be modified based on the targeted garment wearer's dimensions, while maintaining the intended quantity and distribution of pressure. For instance, if the garment were constructed for children, tweens, adult women, or adult men, the dimensions could change. In some embodiments, the superior edge and/or inferior edge of the waistband could range from 15 inches to 70 inches in circumference, depending on the garment wearer's dimensions. For instance, the standard waist circumference in general off-the-rack clothing for adult women can range from 24 inches (extra small, XS) to 43 inches (triple extra large, XXXL), in some brands. FIGS. 8 and 9 also depict front panel 40 as shorter than rear panel 50, which can be done for aesthetic purposes of the constructed garment.

Figure 10:
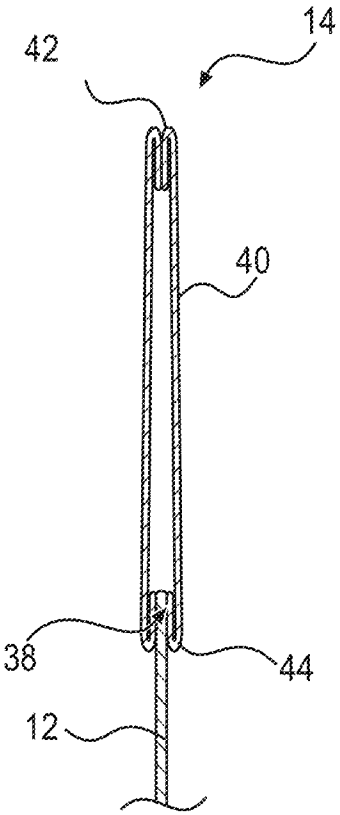
FIG. 10 shows a cross-section of a front portion or a rear portion of a wide, abdominal-shaping waistband.
Figure 11:
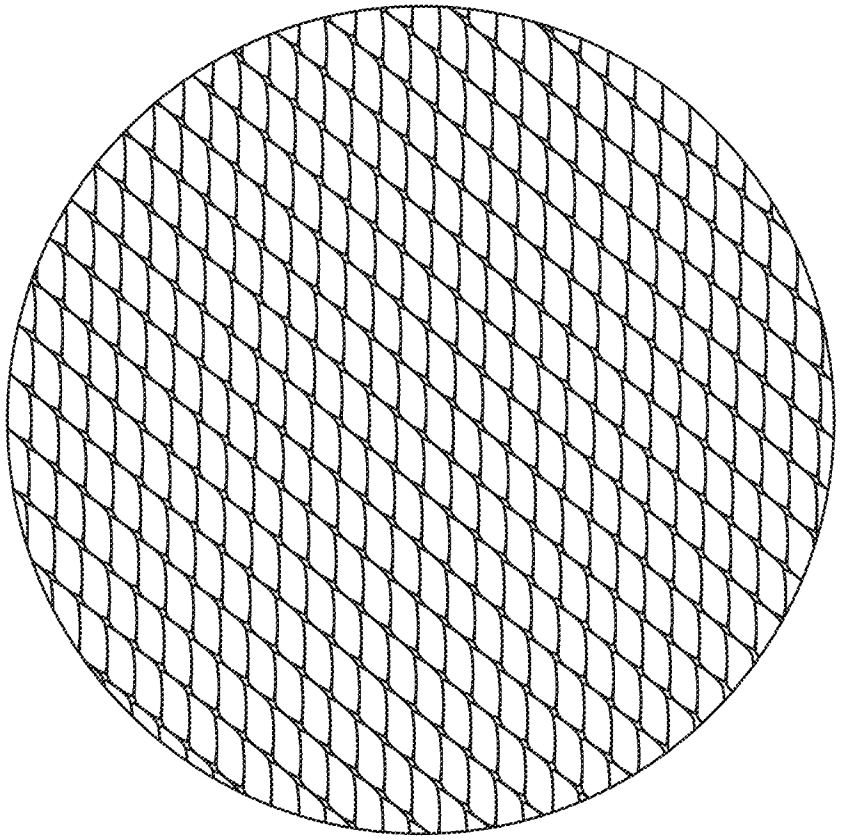
FIG. 11 shows an exploded view of the weave pattern on a wide, abdominal shaping waistband.

FIG. 10 depicts a cross-sectional view of front panel 40. FIG. 10 shows front panel 40 comprising two layers of fabric folded over and sewn together at the top edges. FIG. 10 also shows front panel 40 comprising two layers of fabric folded over at the bottom edges and sewn to the top edge of the lower-abdominal portion 18. Rear panel 50 can also comprise two layers of fabric, and can be constructed in the same way. For instance, assuming all other fabric qualities are equal, two layers of fabric would provide twice the compression of one layer of fabric. When more than one fabric layer is used, the layers need not comprise the same fabric. FIG. 10 shows that the two layers of fabric remain slidably movable with respect to one another, as the two layers of fabric are connected (e.g., fused, sewn, adhered, foamed etc.) along the inner or midline portions. This can provide a more comfortable garment, allowing the wearer to have freer movement in a garment that is less prone to rolling down during wear. It can also provide a more comfortable garment by allowing the use of, for instance, a less stiff fabric for the layers. Two layers are not necessary to achieve the desired compression, though: one layer or three layers, for instance, can also be used. The number and type of waistband fabric layers can be varied to, for instance, vary the compression provided by the waistband.

Additionally, the height of the waistband can be varied to provide compression to more of the garment-wearer's abdominal region, if desired. The height, h, of the waistband is depicted in FIGS. 8 and 9. In some examples, the waistband is at least 3 inches to 12 inches in height (e.g., 4 inches to 10 inches, or 4.5 inches to 9 inches, or 5 inches to 8 inches). The height of the waistband 14 can be measured relative to the length of the front crotch seam 28. The waistband height can be 40% to 200% (e.g., 50% to 160%, 60% to 100%, 65% to 90%, or 40% to 70%) of the length of the front crotch seam. In one example, the waistband is 3 inches in height, and the front crotch seam is 7.5 inches. In that example, the waistband height is 40% relative to the front crotch seam length. In another example having a very tall waistband (extending across the abdominals and up onto the rib cage of the wearer) on a small adult, may have a 12 inch waistband on a garment having a 6 inch front crotch seam. In that example, the waistband height is 200% relative to the front crotch seam length. This variation of 40% to 200% takes into account the various heights of the garment wearers and the various widths of the wide waistbands that can be used herein. Varying the height of the waistband can also reduce muffin top by allowing a greater surface area for compression. Varying the height of the waistband can also reduce undesirable roll down of the garment during wear.

The waistbands disclosed herein comprise an elastomer-containing woven fabric (e.g., denim, twill, chino, sateen, corduroy, leather). FIG. 12 depicts an exploded view of a weave pattern of the woven fabrics of some examples disclosed herein. The woven fabric comprises 1% to 20% (e.g., 1.5% to 3%), by weight, of elastomer and 80% to 99%, by weight, of non-elastomer. An elastomer is a viscoelastic polymer that often has a high failure strain and low elastic modulus, when compared with other materials. The elastomer-containing woven fabric is not a narrow elastic, as depicted in FIG. 13, for purposes of this application. Additionally, it is understood that some polyesters can be considered elastomers. Nonetheless, as defined herein, elastomer does not include a polyester for purposes of this application.

The non-elastomer can comprise, for instance, polyester, cotton, regenerated cellulosic yarn, rayon, viscose, modal, TENCEL®, CVC (chief value cotton), CVS (chief value synthetic) or a mixture thereof. The elastomer-containing woven fabric can comprise, for instance 0% to 40% polyester (e.g., 1% to 25%, 5% to 20%). In one example, the elastomer-containing woven fabric comprises 81% cotton, 17% polyester, and 2% spandex. In another example, the elastomer-containing woven fabric comprises 93% cotton, 6% polyester, and 1% spandex.

The composition of the fabric can be selected to help provide the desired quantity and distribution of pressure on the wearer's abdominal area. The number of layers of fabric used can impact the decision of which fabric to use, as discussed above. In addition, fabrics having the properties outlined below are suited for use in the garments disclosed herein.

The fabric can have any fabric weight that allows for the desired quantity and distribution of pressure on the wearer's abdominal area. In some aspects, the fabric has a fabric weight of 7 ounces per square yard (osy) to 14 osy of the original fabric. In some aspects, the fabric has a fabric weight of 7 osy to 16 osy (e.g., 9 osy to 12 osy), after three home launderings.

The fabric can have any filling stretch that allows for the desired quantity and distribution of pressure on the wearer's abdominal area. In some aspects, the fabric has a filling stretch of 31% to 40% as measured by ASTM D 3107-07 (2011).

The fabric can have any fabric growth that allows for the desired quantity and distribution of pressure on the wearer's abdominal area. In some aspects, the fabric has a fabric growth of 4% to 7% as measured by ASTM D 3107-07 (2011).

The fabric can have any warp shrinkage and/or filling shrinkage that allows for the desired quantity and distribution of pressure on the wearer's abdominal area. In some aspects, the fabric has a warp shrinkage and/or a filling shrinkage as measured by AATCC 135-2012 of −13.5% to 1% (e.g., −4% to 1%, −3% to −1%).

The fabric can have any stiffness that allows for the desired quantity and distribution of pressure on the wearer's abdominal area. In some aspects, the fabric has stiffness as measured by ASTM D 4032-94 of 0 lb to 6 lbs (e.g., 1 lb to 2 lb).

The fabric can have any tensile strength, in warp and fill (W×F), that allows for the desired quantity and distribution of pressure on the wearer's abdominal area. In some aspects, the fabric has tensile strength in warp, as measured by ASTM D 5034 09 (2013) of from 80 lb to 151 lb (e.g., 80 lb to 110 lb or 151 lb to 159 lb). In some aspects, the fabric has tensile strength in fill, as measured by ASTM D 5034 09 (2013). of from 40 lb to 160 lb (e.g., 40 lb to 65 lb or 72 lb to 134 lb). The tensile strength can be reported as a warp by fill (W×F) nomenclature, e.g., 80×40.

The fabric can have any tear strength, in warp and fill (W×F), that allows for the desired quantity and distribution of pressure on the wearer's abdominal area. In some aspects, the fabric has tear strength in warp, as measured by ASTM D 1424 09 (2013) of from 5 lb to 15 lb (e.g., 5 lb to 7 lb or 14.5 lb to 15 lb). In some aspects, the fabric has tear strength in fill, as measured by ASTM D 1424 09 (2013) of from 3 lb to 13 lb (e.g., 3 lb to 5 lb or 10 lb to 13 lb). The tear strength can be reported as a warp by fill (W×F) nomenclature, e.g., 10×13.

Also disclosed herein are methods of assembling the garments described herein, by, for instance, cutting two front waistband panels of a height of 3 inches to 12 inches such that they have superior edges laterally narrower than inferior edges, cutting two rear waistband panels of a height of 3 inches to 12 inches such that they have superior edges laterally narrower than inferior edges, sewing the two front waistband panels together at the superior edges, sewing the two rear waistband panels together at the superior edges, sewing lateral edges of the front waistband panels to lateral edges of the rear waistband panels, and sewing the inferior edges of the front waistband panels and the inferior edges of the rear waistband panels to a top edge of a lower-body portion.

The garments and methods of the appended claims are not limited in scope by the specific garments and methods described herein, which are intended as illustrations of a few aspects of the claims and any garments and methods that are functionally equivalent are intended to fall within the scope of the claims. Various modifications of the garments and methods in addition to those shown and described herein are intended to fall within the scope of the appended claims. Further, while only certain representative garments and method steps disclosed herein are specifically described, other combinations of the garments and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated.

What is claimed is:

1. A garment for shaping abdominals of a wearer, the garment comprising:

a lower-body portion configured to extend inferiorly along at least a portion of the legs of the wearer; and an abdominal-shaping waistband having a stiffness of up to 6 pounds;

wherein the waistband has a height of from 3 inches to 12 inches; and wherein the waistband comprises at least two layers of an elastomer-containing fabric.

2. The garment of claim 1, further comprising a taper extending between a superior edge of the abdominal-shaping waistband and an inferior edge of the abdominal-shaping waistband, wherein the superior edge is laterally narrower than the inferior edge of the abdominal-shaping waistband.

3. The garment of claim 2, wherein the superior edge has a width of 85% to 92% of a width of the inferior edge of the abdominal-shaping waistband.

4. The garment of claim 3, wherein the taper of the abdominal-shaping waistband is configured to apply greater pressure on the wearer along a horizontally extending midline than along the superior edge of the abdominal-shaping waistband.

5. The garment of claim 4, wherein the abdominal-shaping waistband has a horizontally extending midline that is laterally narrower than the inferior edge of the abdominal-shaping waistband, and wherein the horizontally extending midline of the abdominal-shaping waistband is wider than the superior edge of the abdominal-shaping waistband.

6. The garment of claim 4, wherein the abdominal-shaping waistband has a superior edge ranging from 15 inches to 70 inches.

7. The garment of claim 5, wherein the abdominal-shaping waistband has an inferior edge ranging from 15 inches to 70 inches.

8. The garment of claim 1, wherein the abdominal-shaping waistband has a filling stretch of 31% to 40%.

9. The garment of claim 1, wherein the abdominal-shaping waistband comprises a fabric having a weight of 7 oz/yd$^2$ to 14 oz/yd$^2$.

10. The garment of claim 1, wherein the abdominal-shaping waistband has a height relative to a front crotch seam of the garment of 40% to 70%.

11. The garment according to claim 1, wherein the abdominal-shaping waistband comprises an elastomer-containing fabric comprising 1% to 3% of an elastomer.

12. The garment of claim 1, wherein the abdominal-shaping waistband has a closure seam that can be fastened together using a fastener chosen from the group consisting of a zipper, a button and a buttonhole, a snap and a snap eyelet, a hook and a hook eye, a rivet and a stud, and a combination thereof.

13. The garment of claim 12, wherein the closure seam is located on a side of the garment.

14. The garment of claim 12, wherein the abdominal-shaping waistband has the same elasticity as the lower body portion.

15. The garment of claim 12, wherein the lower-body garment comprises a woven fabric.

16. The garment of claim 1, wherein the elastomer-containing fabric comprises 1% to 3% of an elastomer and 1% to 40% polyester.

17. The garment of claim 16, wherein the elastomeric containing fabric further comprises 57% to 98% cotton.

18. A method of assembling a garment, comprising:

providing a lower body portion of the garment;

cutting two front waistband panels of a height of 3 inches to 12 inches such that they have superior edges laterally narrower than inferior edges, cutting two rear waistband panels of a height of 3 inches to 12 inches such that they have superior edges laterally narrower than inferior edges, sewing the two front waistband panels together at the superior edges;

sewing the two rear waistband panels together at the superior edges;

sewing lateral edges of the front waistband panels to lateral edges of the rear waistband panels; and sewing the inferior edges of the front waistband panels and the inferior edges of the rear waistband panels to a top edge of a lower-body portion.

19. The method of claim 18, wherein providing a lower body portion further comprises sewing a superior portion of medial edges of two front lower body portion panels together to form a front crotch seam, sewing a superior portion of medial edges of two rear lower body portion panels together to form a rear crotch seam, and sewing lateral edges of the two front lower body portion panels to lateral edges of the two rear lower body portion panels to form side seams.

20. The method of claim 19, further comprising sewing an inferior portion of the medial edges of the front lower body portion panels to an inferior portion of the medial edges of the rear lower body portion panels to form inseams.

* * * * *